US010933954B2

(12) United States Patent
Butler, III et al.

(10) Patent No.: US 10,933,954 B2
(45) **Date of Patent: *Mar. 2, 2021**

(54) EMERGENCY VESSEL TOWING SYSTEM AND METHOD

(71) Applicant: ALASKA MARITIME PREVENTION AND RESPONSE NETWORK, Anchorage, AK (US)

(72) Inventors: James N. Butler, III, Kenai, AK (US); David Scott DeVilbiss, Seattle, WA (US); Kenneth Lee FitzGerald, Vashon, WA (US); Kristofer Lindberg, Seattle, WA (US); John Phillip Reed, Coral Springs, FL (US); Peter Scott Soles, Fox Island, WA (US)

(73) Assignee: Alaska Maritime Prevention and Response Network, Anchorage, AK (US)

( * ) Notice: Subject to any disclaimer, the term of this patent is extended or adjusted under 35 U.S.C. 154(b) by 143 days.

This patent is subject to a terminal disclaimer.

(21) Appl. No.: 16/222,298

(22) Filed: Dec. 17, 2018

(65) Prior Publication Data

US 2019/0118910 A1 Apr. 25, 2019

Related U.S. Application Data

(63) Continuation of application No. 15/611,384, filed on Jun. 1, 2017, now Pat. No. 10,279,870.
(Continued)

(51) Int. Cl.
*B63B 21/56* (2006.01)
*B63B 21/48* (2006.01)
(Continued)

(52) U.S. Cl.
CPC ..... *B63B 21/56* (2013.01); *B63B 21/10* (2013.01); *B63B 21/48* (2013.01); *B63B 21/60* (2013.01); *B63B 22/00* (2013.01); *B63B 35/68* (2013.01)

(58) Field of Classification Search
CPC ..... B63B 21/10; B63B 21/48; B63B 21/56; B63B 2021/566; B63B 21/58; B63B 21/60; B63B 22/00; B63B 35/68
See application file for complete search history.

(56) References Cited

U.S. PATENT DOCUMENTS 1,016,619 A 2/1912 Froger
1,378,102 A 5/1921 Froger
(Continued)

FOREIGN PATENT DOCUMENTS

KR 20140049258 A 4/2014
WO 8801586 A1 3/1988
(Continued)

OTHER PUBLICATIONS

Extended Search Report and Written Opinion dated Dec. 12, 2019 from Applicant's counterpart application EP 17814113.1.
(Continued)

*Primary Examiner* — Ajay Vasudeva
(74) *Attorney, Agent, or Firm* — Jones Walker LLP

(57) ABSTRACT

An emergency vessel towing system includes a vessel attachment system, a retrieving system, and a towing line. The vessel attachment system is configured to connect to a vessel at sea, and includes a bridle system and a hawser line. The bridle system is operatively connected to the hawser line's proximal end. The bridle system is configured to engage fittings on two sides of a foredeck of the vessel to distribute the load over the foredeck. The retrieving system includes a retrieving line with a proximal end that is detach-
(Continued)

ably connected to the hawser line's distal end in a setup position. The towing line is detachably connected to the hawser line's distal end in a towing position.

17 Claims, 12 Drawing Sheets

Related U.S. Application Data

(60) Provisional application No. 62/447,520, filed on Jan. 18, 2017, provisional application No. 62/351,610, filed on Jun. 17, 2016.

(51) Int. Cl.

| | |
|---|---|
| ***B63B 21/60*** | (2006.01) |
| ***B63B 35/68*** | (2006.01) |
| ***B63B 21/10*** | (2006.01) |
| ***B63B 22/00*** | (2006.01) |

(56) References Cited

U.S. PATENT DOCUMENTS

| | | | | |
|---|---|---|---|---|
| 1,423,576 | A | 7/1922 | Miller | |
| 2,318,150 | A | 5/1943 | Foss | |
| 2,536,682 | A | 1/1951 | Frieder et al. | |
| 2,920,598 | A * | 1/1960 | Nielsen | B63B 34/67 114/253 |
| 2,943,591 | A * | 7/1960 | Schneider | B63B 34/63 114/253 |
| 2,984,202 | A | 5/1961 | Lunde | |
| 3,459,151 | A * | 8/1969 | Takeshi | B63B 21/48 114/311 |
| 3,472,195 | A * | 10/1969 | Takeshi | B63B 21/48 114/311 |
| 3,780,989 | A | 12/1973 | Peterson | |
| 4,007,702 | A | 2/1977 | Cave et al. | |
| 4,275,677 | A | 6/1981 | Nelson | |
| 4,766,837 | A * | 8/1988 | Parish | B63B 21/48 114/311 |
| 5,529,010 | A | 6/1996 | Johnson et al. | |
| 6,550,413 | B2 | 4/2003 | Fiorentino et al. | |
| 7,516,713 | B1 | 4/2009 | Franta | |
| 10,189,546 | B2 * | 1/2019 | Butler, III | B63B 21/10 |
| 10,279,870 | B2 * | 5/2019 | Butler, III | B63B 22/00 |
| 2015/0251732 | A1 | 9/2015 | Kooren et al. | |
| 2017/0361906 | A1 | 12/2017 | Butler, III et al. | |

FOREIGN PATENT DOCUMENTS

| | | | |
|---|---|---|---|
| WO | 9711876 | A1 | 4/1997 |
| WO | 9718989 | A1 | 5/1997 |
| WO | 0035745 | A1 | 6/2000 |

OTHER PUBLICATIONS

Alaska Emergency Towing System (ETS) Procedures Manual, Jan. 2014; V004, by Alaska ETS Workgroup.

U.S. Appl. No. 15/611,195, "Emergency Ship Arrest System and Method," James N. Butler, III et al., filed Jun. 1, 2017 (co-pending application).

International Search Report and Written Opinion dated Aug. 24, 2017, from Applicant's counterpart International Patent Application No. PCT/US2017/037732.

Alaska ETS. Alaska Emergency Towing System (ETS) Procedures Manual. Jan. 2014. Retrieved from the Internet on [Jul. 29, 2017]. <URL: https://dec.alaska.gov/Spar/ppr/ets/documents/ETS%20V4%2001152014.%20non%20press.pdf> pp. 1-54.

* cited by examiner

EMERGENCY VESSEL TOWING SYSTEM AND METHOD

CROSS REFERENCE TO RELATED APPLICATIONS

This application is a continuation of U.S. patent application Ser. No. 15/611,384, filed on Jun. 1, 2017, which claims the benefit of and priority to U.S. Provisional Patent Application No. 62/351,610, filed on Jun. 17, 2016, and U.S. Provisional Patent Application No. 62/447,520, filed on Jan. 18, 2017, all of which are incorporated by reference herein in their entireties.

BACKGROUND

Commercial shipping routes on the world's oceans pass through remote areas often with limited support infrastructure and severe met-ocean conditions. One such route, the great circle route between Asia and the North American West Coast, happens to be one of the busiest commercial shipping routes in the world. It passes directly through the Aleutian Archipelago and the southern portion of the Bering Sea. Electrical and mechanical system failures, loss of propulsion, and other issues experienced on large ocean-going vessels can and have resulted in significant marine casualties and oil spills in this area. A need exists for a safe means of attachment to disabled vessels for towing. Given its remoteness and the density of marine traffic in the area, the need is especially pronounced in the offshore waters of Alaska and the Bering Sea.

DETAILED DESCRIPTION OF SELECTED EMBODIMENTS

An emergency vessel towing system may be deployed to a disabled vessel that is in a free drift state to control the motion of the vessel. The system provides a safe method of attaching to the vessel. The system also distributes and equalizes a towing load over multiple connection points on the vessel's foredeck. Vessel as used herein means any ocean-going ship such as a commercial tank vessel, a container vessel, and a bulk carrier. Ocean as used herein means any ocean, sea, or any other body of water. Towing as used herein refers to any process involving attachment of ropes, cables, or any other line to a vessel in water to change, adjust, or control the position or location of the vessel, including pulling the vessel from one location to another, rotating the vessel, and docking the vessel.

The emergency vessel towing system may include a vessel attachment system configured to attach to a foredeck of the disabled vessel, and a retrieving system configured to connect to the vessel attachment system in a setup position.

Figure 1:
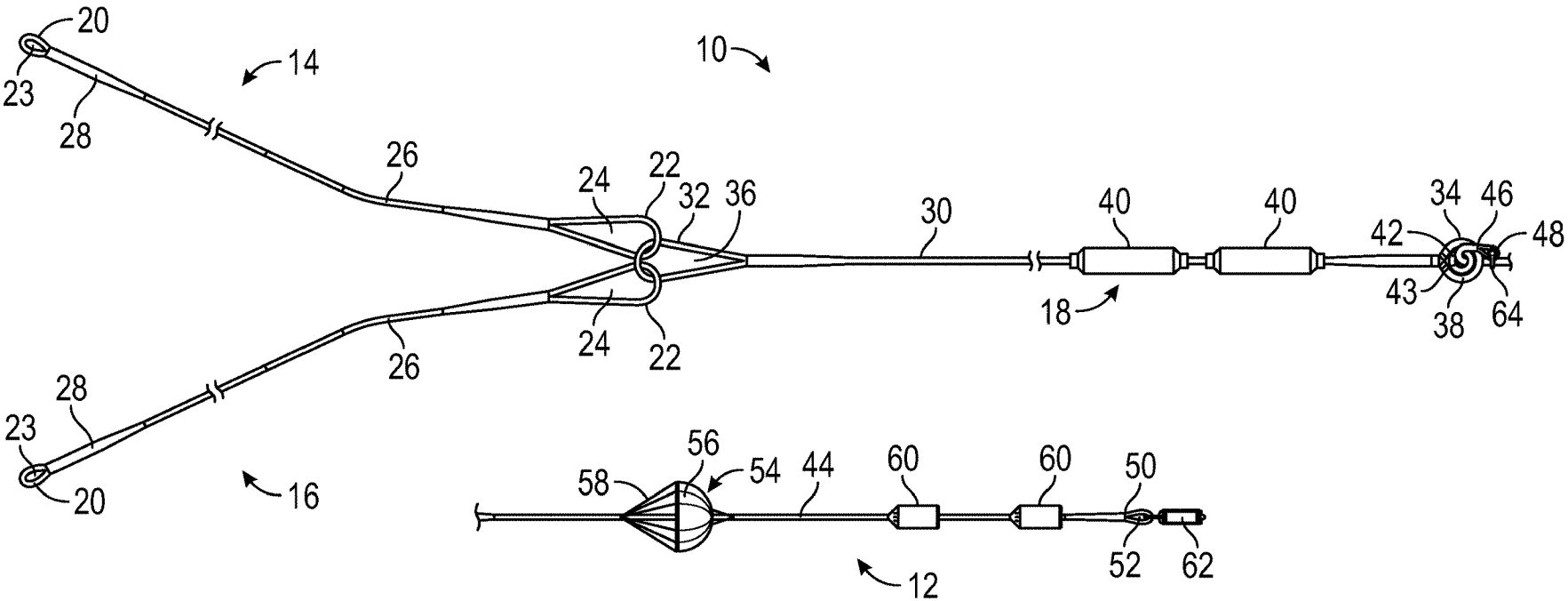
FIG. 1 is a top view of a vessel attachment system and a retrieving system.

FIG. 1 illustrates vessel attachment system 10 and retrieving system 12 in a setup position. Vessel attachment system 10 may include first bridle 14, second bridle 16, and hawser assembly 18. First and second bridles 14 and 16 may each extend from proximal ends 20 to distal ends 22. In one embodiment, proximal ends 20 may each include proximal eye 23 configured to allow connection to an extension line. For example, an extension line may be connected to the proximal eyes of bridles 14 and 16 to lengthen bridles 14 and 16 to secure vessel attachment system 10 to vessels having foredeck fittings positioned further apart. Distal ends 22 may each include distal eye 24. Bridles 14 and 16 may each have a length between 10 and 150 meters, or any subrange therein. In one embodiment, bridles 14 and 16 may each have a length of between 70 and 85 meters, or any subrange therein. Bridles 14 and 16 may each have an outer diameter in the range of 24 to 152 millimeters, or any subrange therein. Bridles 14 and 16 may be composed of multiple stands of ultra-high-molecular-weight polyethylene or other synthetic fibers. In one embodiment, first and second bridles 14 and 16 may be formed of 68 mm Samson Quantum®-12 line. Bridles 14 and 16 may each include protected sections 22, 26, and 28, which may be coated, painted, reinforced, or jacketed with chafe protection to prevent abrasion of fibers in high stress and high friction areas.

Hawser assembly 18 may include hawser line 30 extending from proximal end 32 to distal end 34. Hawser line 30 may a length in the range of 50 to 300 meters, or any subrange therein, and an outer diameter in the range of 24 to 152 millimeters, or any subrange therein. Hawser line 30 may be formed of a light weight, high-strength material, with high pliability and positive buoyancy in seawater, such a line constructed of ultra-high-molecular-weight polyethylene fibers or other synthetic fibers. For example, hawser line 30 may be formed of 68 mm Samson Amsteel®-Blue.

Proximal end 32 may include proximal eye 36 that engages distal eyes 24 of first and second bridles 14 and 16. Proximal eye 36 may include Samson DC Gard to protect against chafing due to friction with distal eyes 24 of distal ends 22 of bridles 14 and 16. Distal end 34 of hawser line 30 may include distal eye 38. Hawser assembly 16 may also include floats 40 and hawser thimble 42. Floats 40 may provide buoyancy and visibility of hawser line 30. Any number of floats 40 may be connected to hawser line 30. For example, between 1 and 10 floats 40 may be connected to hawser line 30. Hawser thimble 42 may include central opening 43. Hawser thimble 42 may be disposed in distal eye 38 of hawser line 30. Hawser thimble 42 may be formed of an Orkot® thimble or any other thimble capable of providing the strength necessary for the described connections.

Retrieving system 12 may include retrieving line 44 extending from proximal end 46 having proximal eye 48 to distal end 50 having distal eye 52. Retrieving system 12 may also include pilot anchor 54 with canopy 56 and a plurality of shrouds 58. A central portion of canopy 56 may be attached to retrieving line 44. Each of the plurality of shrouds 58 may extend from a perimeter of canopy 56 (i.e., outer edge or outer surface of canopy 56) to retrieving line 44. Retrieving system 12 may further include marker buoys 60 attached to retrieving line 44, and strobing buoy 62 attached to distal eye 52. Proximal end 46 of retrieving line 44 may be disposed through central opening 43 of hawser thimble 42 with retrieving shackle 64 engaging proximal eye 48. In this way, retrieving system 12 is connected to vessel attachment system 10 in the setup position. In other embodiments, retrieving system 12 may be connected to vessel attachment system 10 by connecting retrieving shackle 64 to a strap or rope grommet secured to hawser line 30 near distal end 34. Retrieving line 44 may have a length in the range of 10 to 300 meters, or any subrange therein. Retrieving shackle 64 may be formed of any shackle having a load capacity sufficient to allow recovery of retrieving system 12, such as a screw-pin or bolt-type shackle formed of a durable material such as stainless steel. Retrieving shackle 64 may provide a mechanism for quickly disconnecting retrieving system 12 from vessel attachment system 10.

Figure 3:
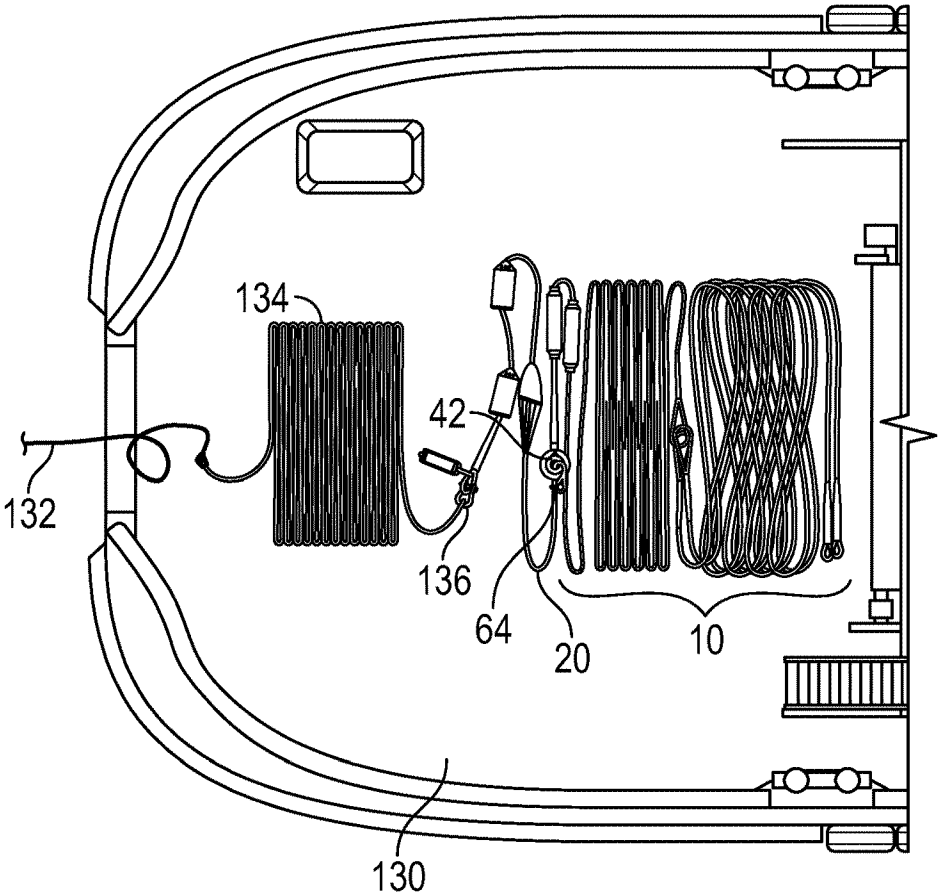
FIG. 3 is a top view of the vessel attachment system and the retrieving system operatively connected to the line gun cord on the responding vessel.
Figure 2:
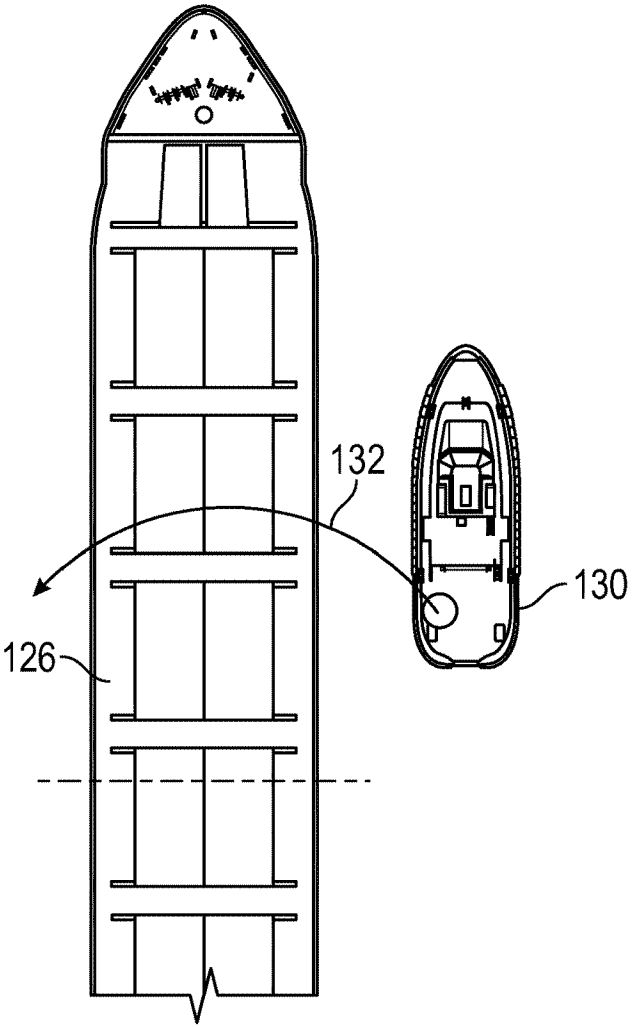
FIG. 2 is a top view of a responding vessel with a line gun cord deployed to a disabled vessel.
Figure 4:
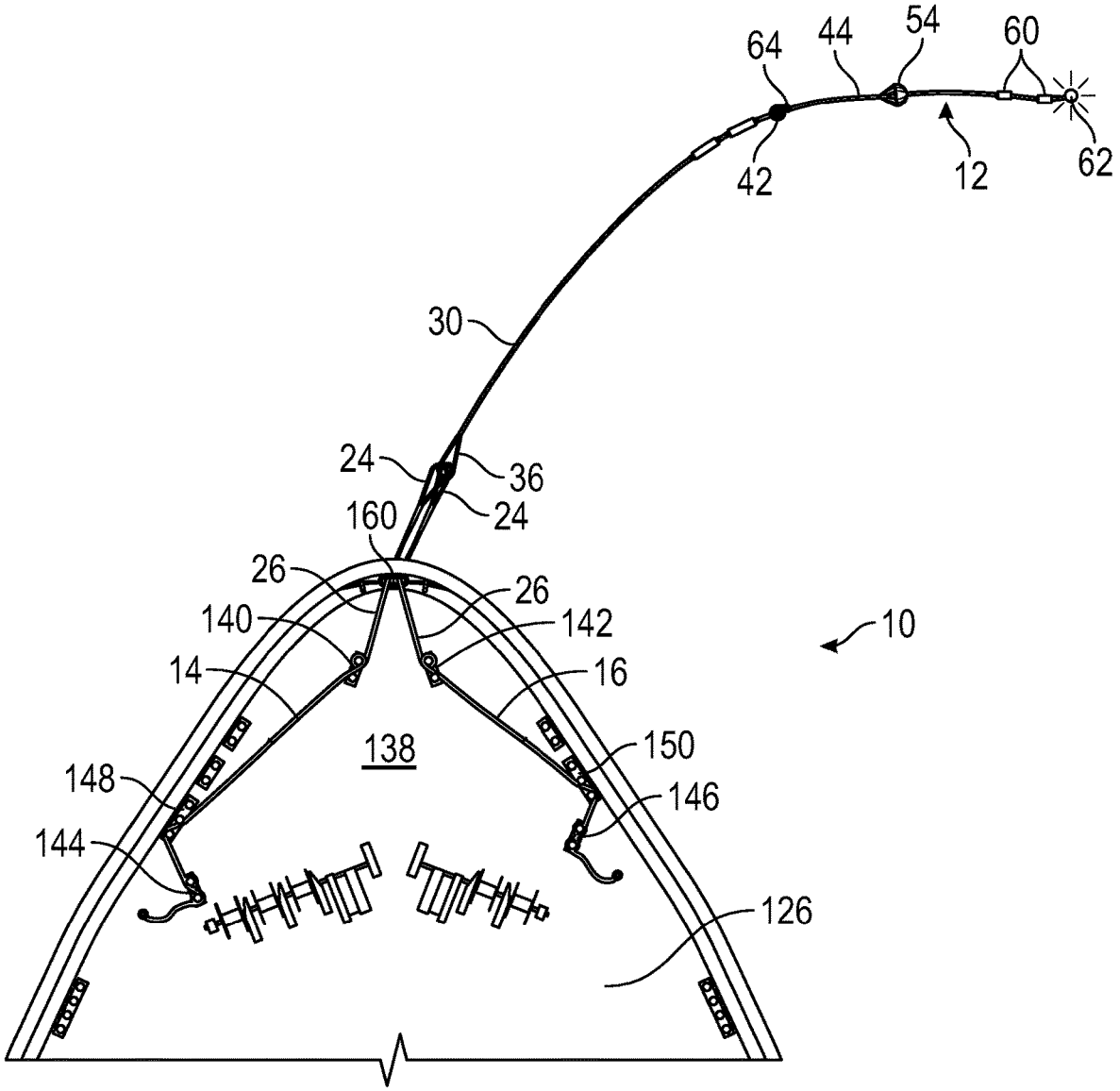
FIG. 4 is a top view of the vessel attachment system and the retrieving system connected to the foredeck of the disabled vessel.
Figure 5:
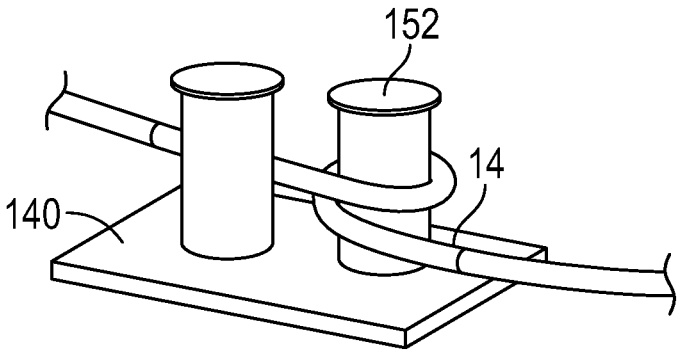
FIG. 5 is a detailed perspective view of a bridle line wrapped around a forward bitt on the foredeck of the disabled vessel.
Figure 6:
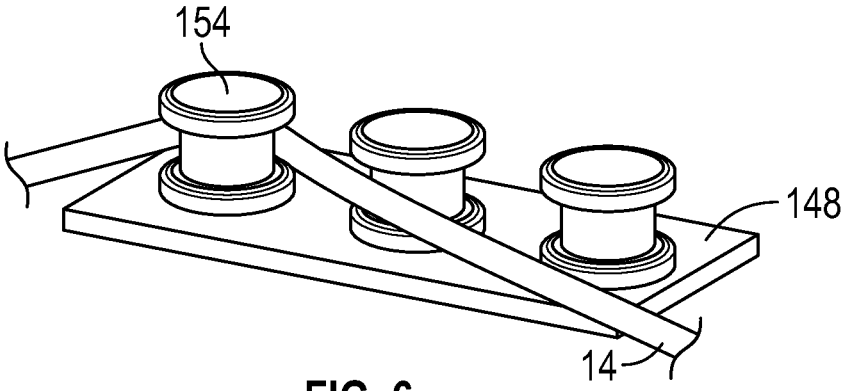
FIG. 6 is a detailed perspective view of the bridle line leading around a fairlead on the foredeck of the disabled vessel.
Figure 7:
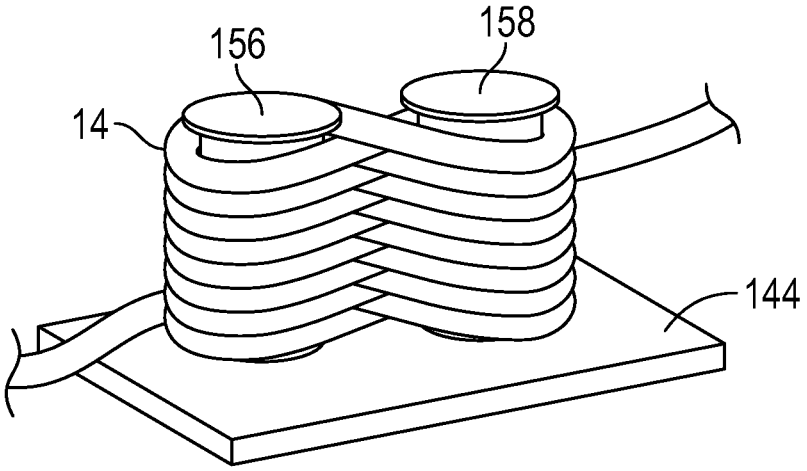
FIG. 7 is a detailed perspective view of the bridle line belayed on an aft bitt on the foredeck of the disabled vessel.

FIGS. 2-9 illustrate the method of deploying the emergency vessel towing system to disabled vessel 126 and securing the system to foredeck 124 of disabled vessel 126. Vessel attachment system 10 and retrieving system 12 may be delivered to disabled vessel 126 by fixed-wing aircraft, helicopter, or boat using a line-throwing appliance. For example, responding vessel 130 may travel to the location of disabled vessel 126 at sea and be positioned alongside disabled vessel 126 as shown in FIG. 2. After taking appropriate safety measures, a line gun may be fired to drape line gun cord 132 across the deck or mid-body of disabled vessel 126. Referring now to FIG. 3, an end of line gun cord 132 may be attached to a first end of messenger line 134 held on responding vessel 130. Messenger line 134 may have a length between 100 and 300 meters, or any subrange therein. For example, messenger line 134 may have a length between 130 and 170 meters. A second end of messenger line 134 may be attached with messenger shackle 136 to distal eye 52 of retrieving system 12, which is in turn connected to vessel attachment system 10 with retrieving shackle 64 and hawser thimble 42. Line gun cord 132, messenger line 134, retrieving system 12, and vessel attachment system 10 may be sequentially pulled onboard disabled vessel 126. Thereafter, messenger shackle 136 may be disconnected from distal eye 52 of retrieving system 12. In some embodiments, proximal eyes 23 of first and second bridles 14, 16 may be used to secure distal ends 20 of bridles 14, 16 together for transfer.

Vessel attachment system 10 may be secured to the foredeck of a disabled vessel. Ship foredeck arrangements vary, but generally include a pair of forward and aft bitts, each pair including one port bitt and one starboard bitt. Foredeck arrangements may also include roller or pedestal type fairleads and other fittings that may be used to align bridles 14 and 16 with the orientation of bitts. First and second bridles 14 and 16 may be secured to any fittings on the foredeck of a disabled vessel, preferably with first bridle 14 engaging two or more fittings on the port side and with second bridle 16 engaging two or more fittings on the starboard side of the disabled vessel.

FIG. 4-8 illustrate one arrangement in which vessel attachment system 10 is secured to foredeck 138 of disabled vessel 126. Foredeck 138 may include forward port bitt 140, forward starboard bitt 142, aft port bitt 144, and aft starboard bitt 146. Foredeck 138 may also include port fairlead 148 and starboard fairlead 150. First bridle 14 may be wrapped once around first post 152 of forward port bitt 140 (shown in FIG. 5), run around post 154 of port fairlead 148 (shown in FIG. 6), and fully belayed around posts 156 and 158 of aft port bitt 144 (shown in FIG. 7). Similarly, second bridle 16 may be wrapped once around a first post of forward starboard bitt 142, run around a post of starboard fairlead 150, and fully belayed around the posts of aft starboard bitt 146.

Figure 9:
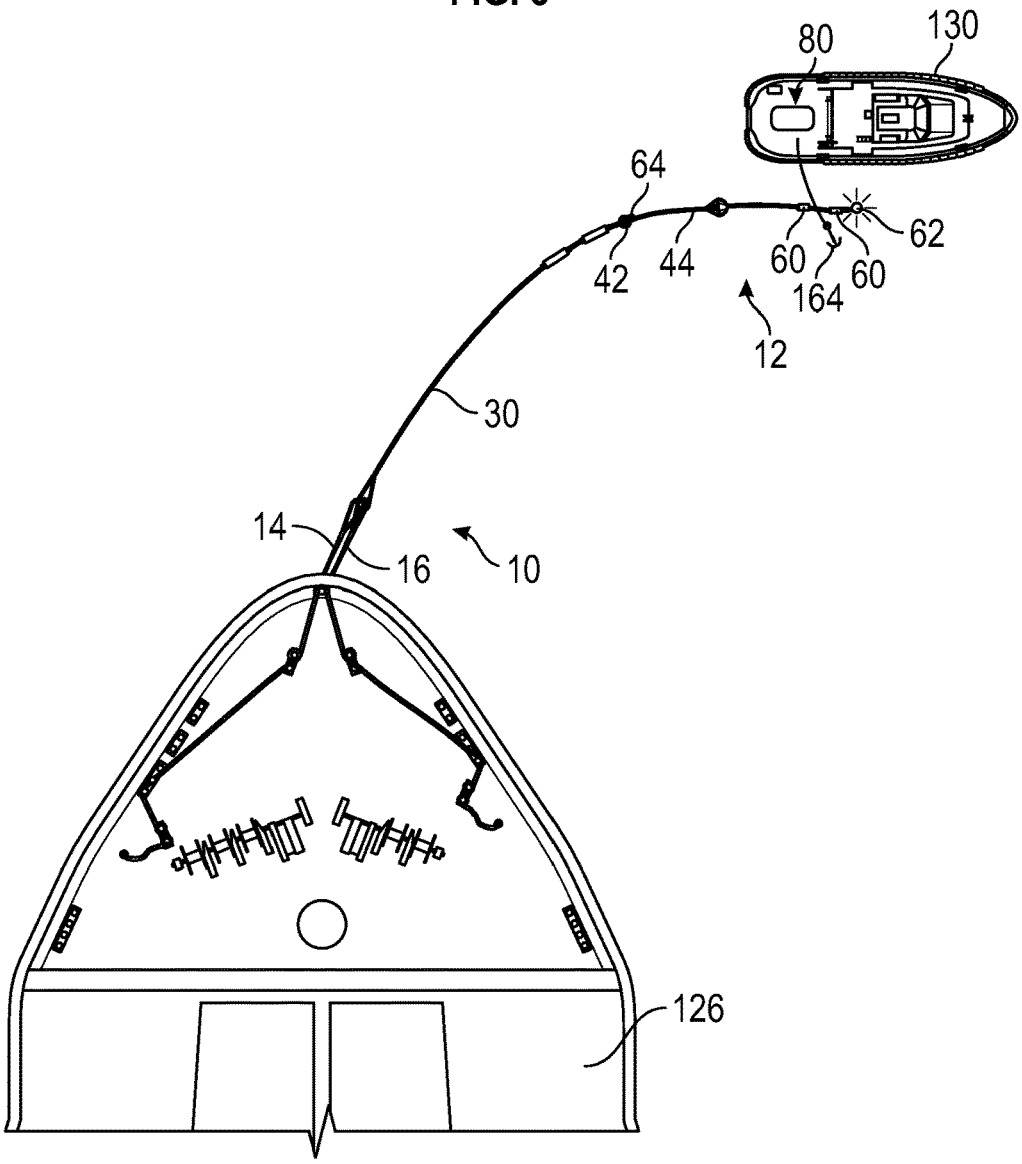
FIG. 9 is a top view of the method of engaging the retrieving line from the responding vessel.

After first and second bridles 14 and 16 are connected to foredeck 138, retrieving system 12 and hawser assembly 18 in the setup position may be routed through one or more chocks of disabled vessel 126 and into the water, beginning with distal end 50 of retrieving system 12. In one embodiment, retrieving system 12 and hawser assembly 18 may be routed through chock 160 in bow 162 of disabled vessel 126 and into the water (as shown in FIG. 9), beginning with distal end 50 of retrieving system 12. In another embodiment, retrieving system 12 may be routed through one chock located on a port side or a starboard side of disabled vessel 126. Alternatively, retrieving system 12 may be routed through two chocks, one on a port side and one on a starboard side of disabled vessel 126.

Figure 8:
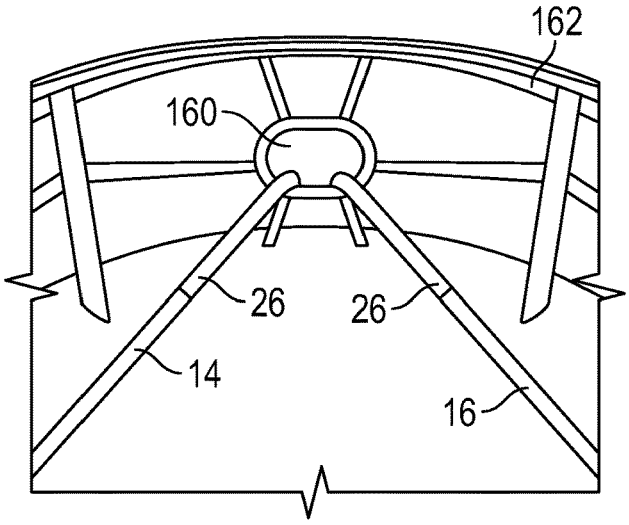
FIG. 8 is a detailed perspective view of the bridle lines leading through a chock in a forward end of the disabled vessel.

As shown in FIG. 8, protected section 26 of first bridle 14 and protected section 26 of second bridle 16 may be positioned through chock 160 of disabled vessel 126 when fully extended. Protected sections 26 may prevent wear or chafing of bridles 14 and 16 that may be caused by movement of bridles 14 and 16 within chock 160. Protected sections 26 may also be positioned around forward port bitt 140 and forward starboard bitt 142, as this may be another high stress and high friction area of bridles 14 and 16.

It should be understood that the specific arrangement illustrated in FIGS. 4-8 is only one embodiment of the method of securing vessel attachment system 10 to foredeck 138, with many other arrangements within the scope of the invention understood by those of skill in the art. Vessel attachment system 10 is a universal system designed to be secured to the foredeck of virtually any ship.

In one embodiment, bridles 14 and 16, hawser line 30, and retrieving system 12 may be configured to position distal end 50 or strobing buoy 62 some distance from disabled vessel 126 to allow safe recovery of distal end 50. In one embodiment, hawser thimble 42 is positioned a distance from disabled vessel 126 that is about one half the length of the disabled vessel when hawser line 30 is completely extended. For example, if disabled vessel 126 has a length of about 300 meters, bridles 14 and 16 may extend about 4 meters beyond chock 160 and hawser line 30 may have a length of about 146 meters.

As shown in FIG. 9, with vessel attachment system 10 and retrieving system 12 attached in the setup position, responding vessel 130 may be positioned near buoys 60 and 62 of retrieving system 12. Retrieving system 12 may be recovered on responding vessel 130 by any known methods, such as with grapple hook 164. After retrieving system 12 is pulled from the water onto responding vessel 130, retrieving shackle 64 may be disconnected from hawser thimble 42.

Figure 10:
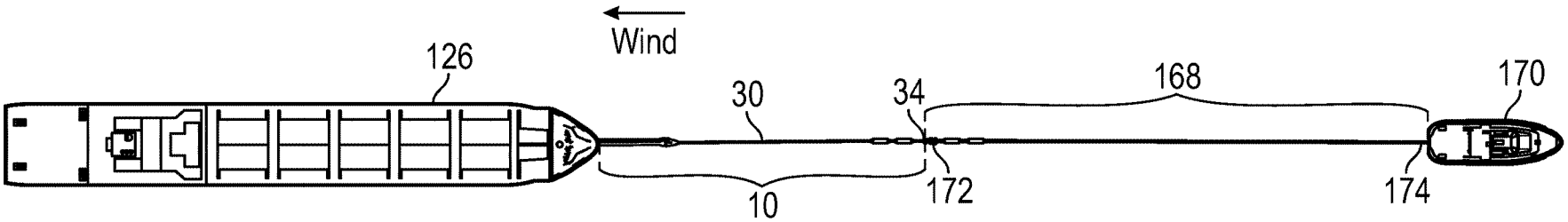
FIG. 10 is a top view of a vessel attachment system attached to a vessel.

With reference to FIG. 10, after disconnecting retrieving shackle 64 from hawser thimble 42, towing line 168 may be secured to towing vessel 170 and to hawser line 30. Specifically, proximal end 172 of towing line 168 may be detachably secured to distal end 34 of hawser line 30, and distal end 174 of towing line 168 may be secured to towing vessel 170. Towing vessel 170 may then tow disabled vessel 126. Vessel attachment system 10 improves the safety, reliability, and versatility of securing a towline between disabled vessel 126 and towing vessel 170 over conventional connection systems.

First and second bridles 14 and 16 of vessel attachment system 10 distribute the line load from hawser line 30 to foredeck fittings, such as bitts 140, 142, 144, 146, fairleads 148, 150, and chock 160. Each of bridles 14 and 16 may attach to two sets of bitts or similar foredeck fittings to effectively distribute a line load applied to hawser line 30, such as from towing line 168. This configuration provides for improved load sharing over conventional methods and systems for emergency towing.

Numerical modeling demonstrated that wrapping each of bridles 14 and 16 once around forward bitts 140 and 142, respectively, and fully belaying each of bridles 14 and 16 on aft bitts 144 and 146, respectively, distributes 50-75% of the line load to forward bitts 140 and 142 and 25-50% of the line load to the aft bitts 144 and 146. This distribution is dependent upon the coefficient of friction of the bridle material and other factors. With bridles 14 and 16 formed of Samson Rope Quantum®-12 having a coefficient of friction of 0.13, about 69% of the line load was distributed to forward bitts 140 and 142 and about 31% of the line load was distributed to aft bitts 144 and 146.

Figure 11:
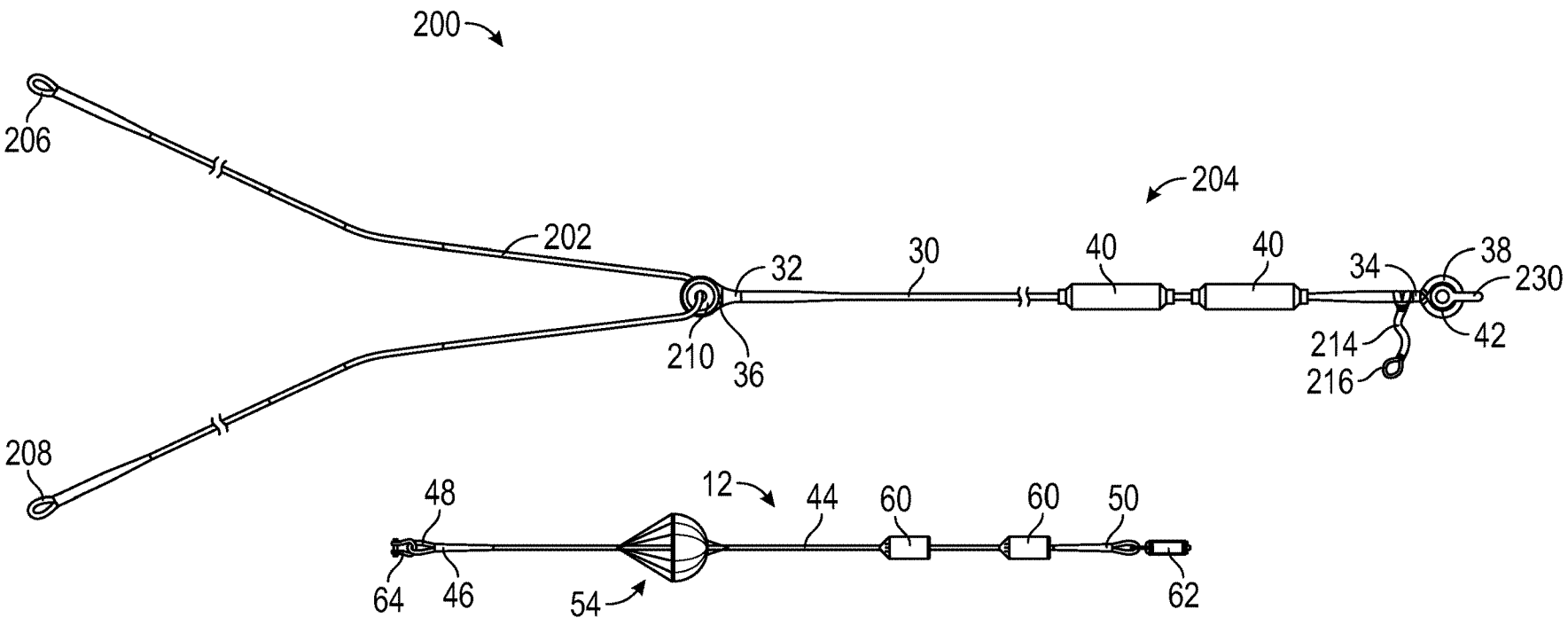
FIG. 11 is a top view of an alternate embodiment of the vessel attachment system and the retrieving system.
Figure 12:
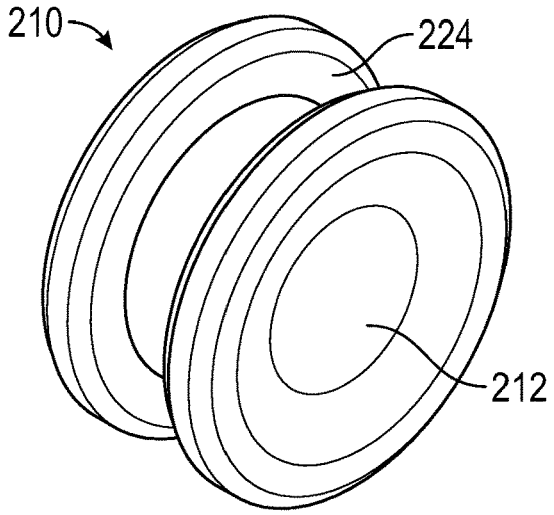
FIG. 12 is a perspective view of a hawser bushing of the vessel attachment system shown in FIG. 11.
Figure 13:
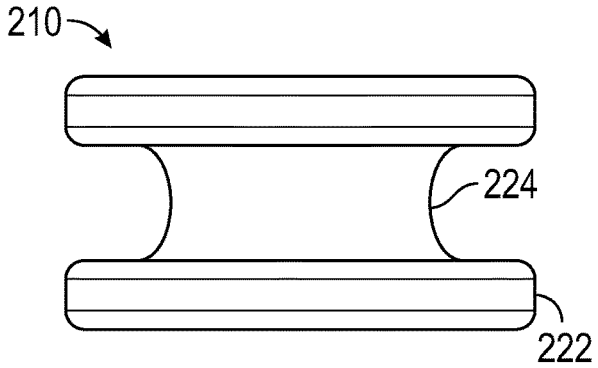
FIG. 13 is a top view of the hawser bushing.
Figure 14:
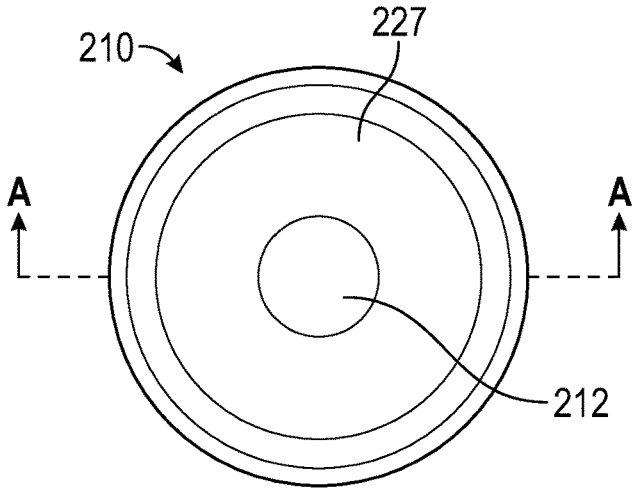
FIG. 14 is a front view of the hawser bushing.

FIG. 11 illustrates an alternate embodiment of the vessel attachment system disclosed herein with retrieving system 12. Vessel attachment system 200 may include continuous bridle 202 and hawser assembly 204. Except as otherwise described, vessel attachment system 200 and hawser assembly 204 may include the same features and materials as vessel attachment system 10 and hawser assembly 18, respectively. These components may be used in connection with retrieving system 12 as described above with reference to FIGS. 1-10.

Continuous bridle 202 may extend from first end 206 to second end 208 (sometimes referred to as proximal ends 206, 208). First and second ends 206, 208 may each include an eye configured to allow connection to an extension line. Continuous bridle 202 may have a length between 20 and 300 meters, or any subrange therein. In one embodiment, continuous bridle 202 may have a length between 140 and 170 meters, or any subrange therein. Continuous bridle 202 may include protected sections in high stress and high friction areas, such as first and second ends 206, 208.

Hawser assembly 204 may include hawser line 30 extending from proximal end 32 to distal end 34. Hawser assembly 204 may also include hawser bushing 210 disposed in proximal eye 36 of hawser line 30. Continuous bridle 202 may be slidingly disposed through central opening 212 of hawser bushing 210 to detachably secure continuous bridle 202 to hawser assembly 204. Continuous bridle 202 may include chafe protection on the section disposed through central opening 212 of hawser bushing 210.

Hawser assembly 204 may further include strap 214. A first end of strap 214 may be attached to hawser line 30 near distal end 34. A second end of strap 214 may include strap eye 216. Strap 214 may be formed of a small synthetic strap or loop, spliced or otherwise attached to hawser line 30 at the base of distal eye 38. In one embodiment, hawser assembly 204 includes a rope grommet instead of strap 214. The rope grommet may be attached to hawser line 30 near distal end 34 by tucking a bight of the rope grommet through the body (braid) of hawser line 30, and passing it over the standing part, effectively choking the rope grommet onto hawser line 30. The rope grommet may be formed of a high strength synthetic material, such as high strength polyethylene fibers.

With reference to FIGS. 12-16, hawser bushing 210 may be formed of a cylindrical-shaped thimble or bushing. Circumferential surface 222 of hawser bushing 210 may include recessed channel 224 for securing hawser bushing 210 in proximal eye 36 of hawser line 30 (as shown in FIG. 11). Central opening 212 may include flared surface profile 227, which may facilitate a movement of hawser bushing 210 along continuous bridle 202. Central opening 212 may include a smooth surface to facilitate the movement of continuous bridle 202 therethrough. In use, continuous bridle 202 engages central opening 212 and flared surface profile 227, while proximal eye 36 of hawser line 30 engages recessed channel 224. Hawser bushing 210 may have a width between 4 and 8 inches, or any subrange therein, and an outer diameter between 9 and 14 inches, or any subrange therein.

Figure 15:
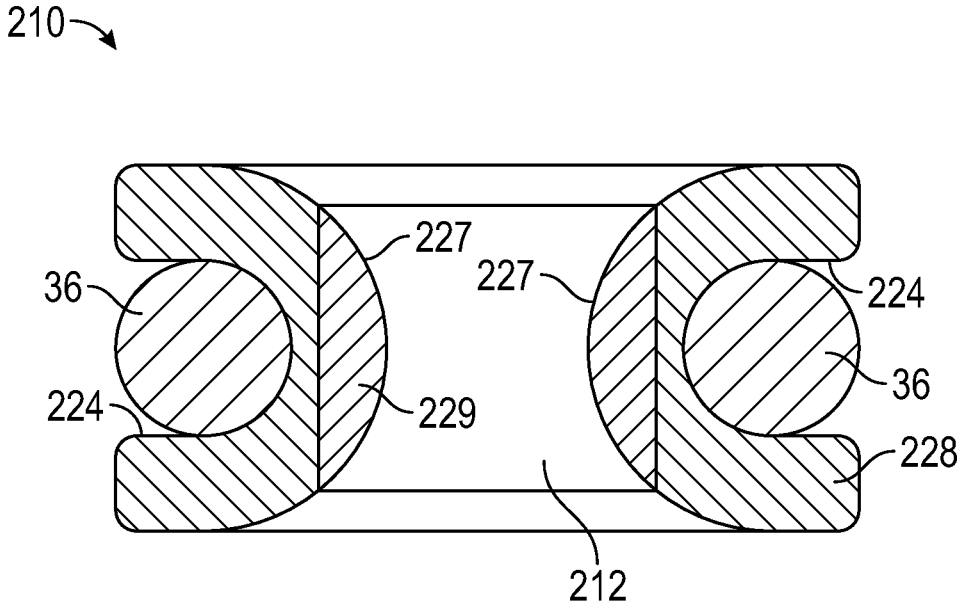
FIG. 15 is a sectional view of one embodiment of the hawser bushing taken along line A-A in FIG. 14.

FIG. 15 is a sectional view of one embodiment of hawser bushing 210, which includes perimeter section 228 and core section 229 disposed within a central bore in perimeter section 228. In one embodiment, flared surface profile 227 is formed by core section 229 and perimeter section 228 as shown in FIG. 15. Alternatively, flared surface profile 227 may be formed by core section 229 alone. In either embodiment, core section 229 provides a smooth surface to facilitate the movement of continuous bridle 202 therethrough. In one embodiment, core section 229 is formed of a high-strength metal (e.g., aluminum, stainless steel, or titanium), and perimeter section 228 is formed of a composite or other high-strength material (e.g., CIP Marine™). In another embodiment, both core section 229 and perimeter section 228 are formed of a solid metal. In use, continuous bridle 202 engages core section 229 and may also engage a portion of perimeter section 228 (i.e., flared surface profile 227), while proximal eye 36 of hawser line 30 engages perimeter section 228 (i.e., recessed channel 224 therein).

Figure 16:
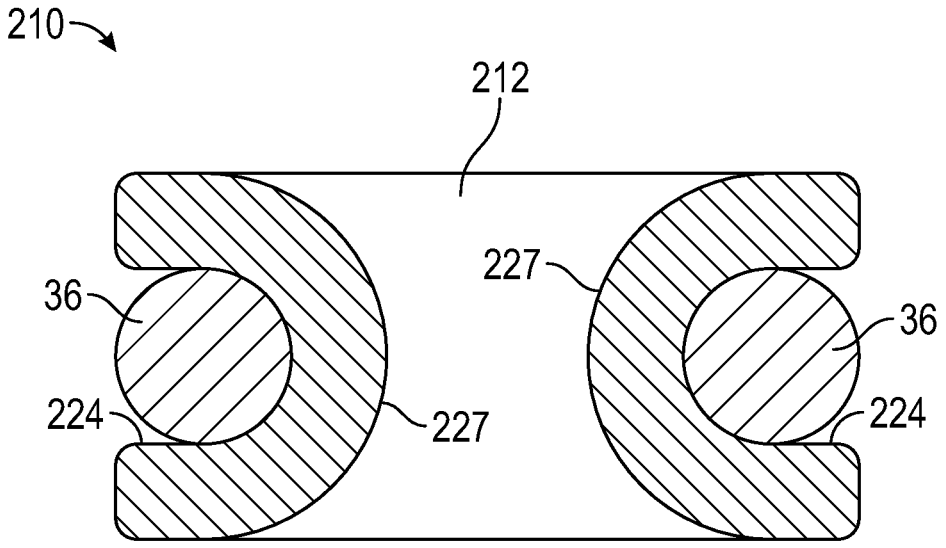
FIG. 16 is a sectional view of an alternate embodiment of the hawser bushing taken along line A-A in FIG. 14.

FIG. 16 illustrates an alternate embodiment of hawser bushing 210. In this embodiment, hawser bushing 210 is formed of a single integrally formed unit. In one embodiment, hawser bushing 210 is formed of a solid metal (e.g., aluminum, stainless steel, or titanium). In another embodiment, hawser bushing 210 is formed of a composite or other high strength material (e.g., CIP Marine™).

Figure 17:
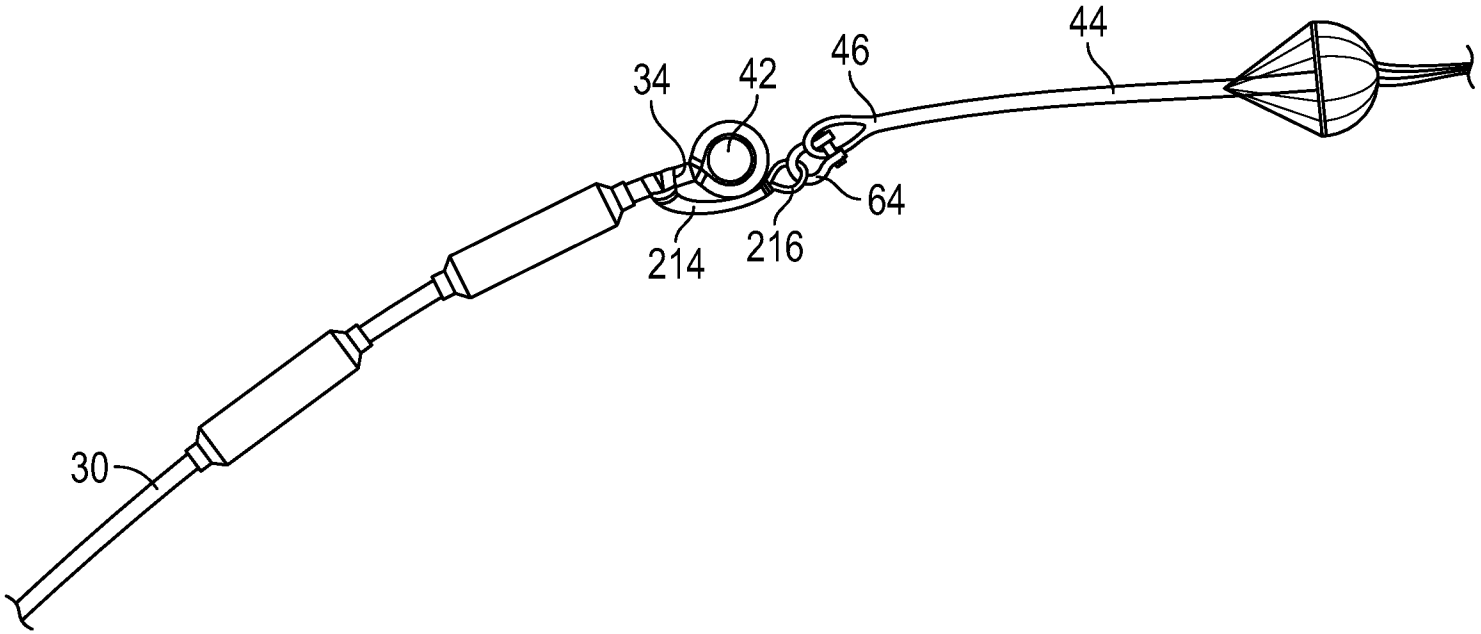
FIG. 17 is a top view of a connection between the vessel attachment system and the retrieving system shown in FIG. 11.

With reference to FIG. 17, proximal end 46 of retrieving line 44 may be attached to strap eye 216 (or the rope grommet in the alternate embodiment) of hawser assembly 204 with retrieving shackle 64 or other hardware. This configuration allows distal end 34 of hawser line 30 to be hauled aboard and temporarily secured on a responding vessel without obstructing the central opening of hawser thimble 42. Thus, the central opening of hawser thimble 42 remains free of interferences and can be immediately connected to the proximal end of the towline of a suitable towing vessel.

Figure 18:
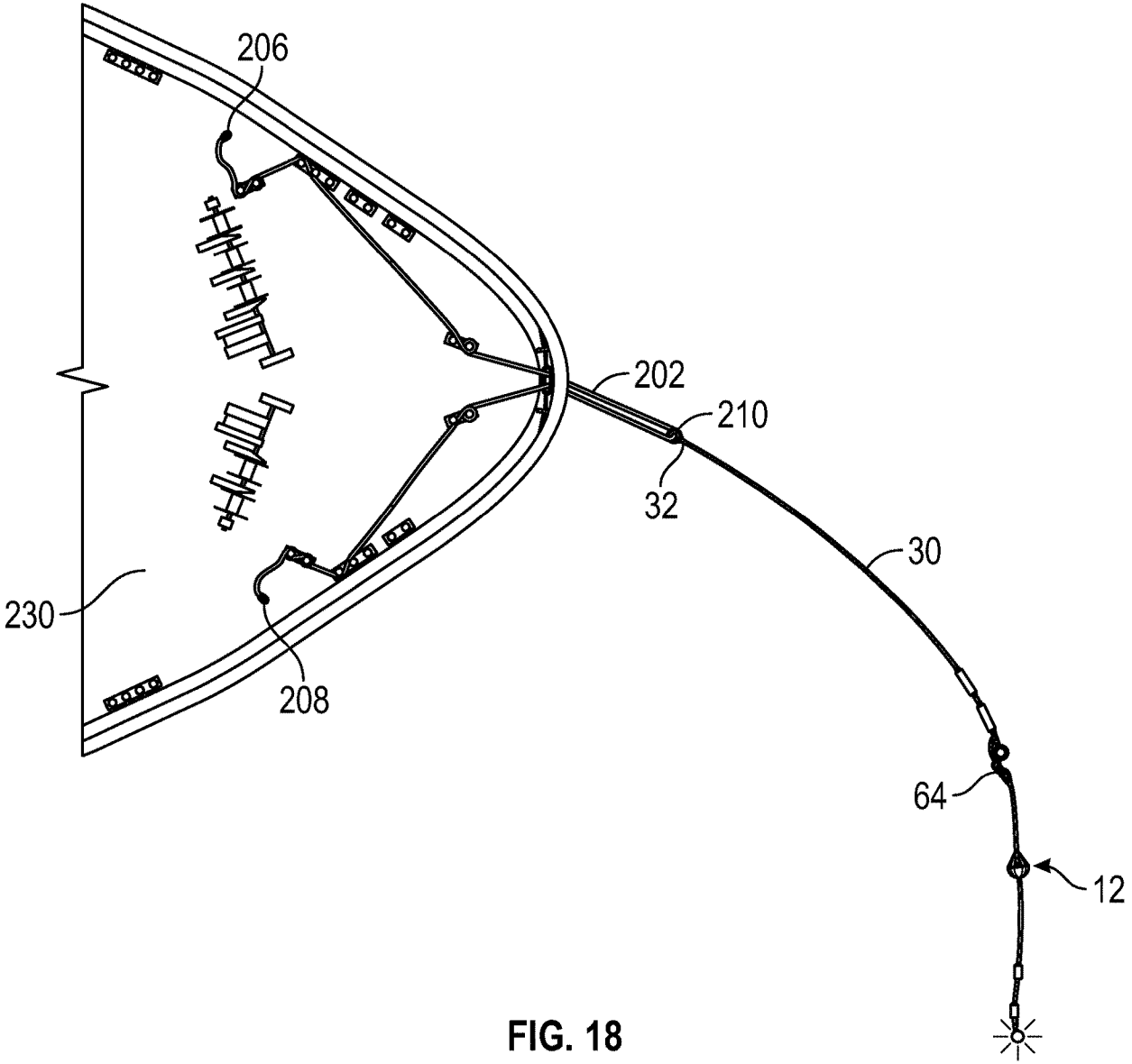
FIG. 18 is a top view of the vessel attachment system shown in FIG. 11 attached to the foredeck of a vessel.
Figure 19:
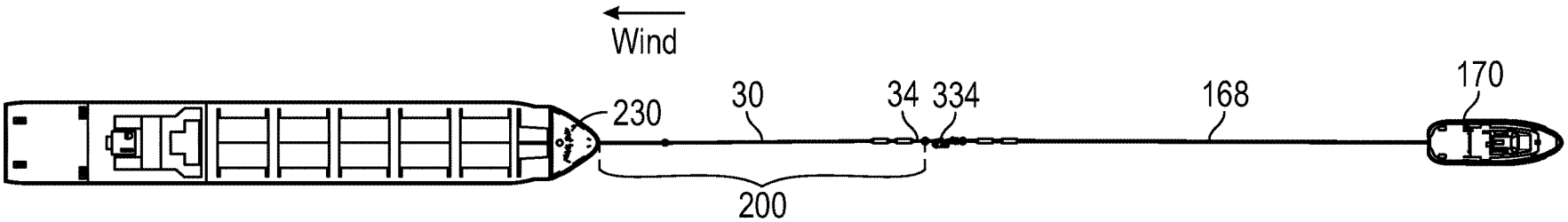
FIG. 19 is a top view of the vessel attachment system shown in FIG. 11 attached to a vessel and attached to a towing line from a responding vessel.

Referring now to FIG. 18, continuous bridle 202 may be secured on two sets of bitts on each side (port and starboard) of foredeck 230 of a disabled vessel such that first and second ends 206, 208 of continuous bridle 202 are disposed on each side of foredeck 230. Hawser bushing 210 is free to slide along continuous bridle 202 to ensure proximal end 32 of hawser line 30 is always balanced in the bight, such that there is near-equal load sharing between the port and starboard bitts, regardless of how evenly continuous bridle 202 was apportioned on each side of foredeck 230, and regardless of the angle of hawser line 30 or a towline relative to the heading of the disabled vessel. In other words, this arrangement equalizes the load distribution across foredeck 230 regardless of the exact points of attachment of each end of continuous bridle 202 to the bitts on either side of foredeck 230.

Optionally in this embodiment, a high-strength synthetic line having a small diameter may be used as a safety line for a controlled initial deployment of retrieving system 12 and vessel attachment system 200 from foredeck 230 of the disabled vessel. The safety line features a spliced eye on one end and a bitter end on the other. After securing the eye splice over a cleat or other fitting on the vessel's foredeck, the bitter end may be reeved through central opening 212 of hawser bushing 210 and, after taking up slack, fully belayed on a cleat or deck fitting. This secures the hawser bushing 210 in the bight of the safety line. Upon deployment of retrieving system 12 and vessel attachment system 200 into the water, the safety line takes the initial load and prevents vessel attachment system 200 from being pulled overboard under its own weight. The safety line can then be used to slip hawser bushing 210 to its intended operating position forward of the bow, by removing wraps from the cleat or deck fitting. The ends of continuous bridle 202 can then be secured to the bitts on each side of the foredeck (port and starboard) and the safety line removed.

An emergency vessel towing system including vessel attachment system 200 may be deployed in generally the same manner as described above in connection with vessel attachment system 10. Vessel attachment system 200 and retrieving system 12 may be delivered to a disabled vessel by aircraft or boat using a line-throwing appliance. First and second ends 206 and 208 of continuous bridle 202 may be attached to the foredeck of a disabled vessel as shown in FIG. 18. With vessel attachment system 200 secured to a disabled vessel and retrieving system 12 attached to hawser thimble 42 in the water, a responding vessel may be positioned near buoys 60 and 62 of retrieving system 12. Retrieving system 12 may be recovered on the responding vessel, and retrieving shackle 64 may be disconnected from strap eye 216 of vessel attachment system 200 (or the grommet in the alternative embodiment). Towing line 168 may then be attached to hawser line 30.

FIG. 26 illustrates vessel attachment system 200 attached to foredeck 230 of a disabled vessel. Distal end 34 of hawser line 30 may be attached to towing line 168 through hook member 334. Hook member 334 may provide for a quick release at the connection between hawser line 30 and towing line 168. Additionally, hook member 334 may provide for a remotely-actuated release at this connection. With hawser line 30 attached to towing line 168, towing vessel 170 may tow the disabled vessel.

Each connection disclosed herein may include any combination of thimbles, bushings, grommets, shackles, line eyes, and quick release mechanisms providing the described connection. Each apparatus, system, and assembly described herein may include any combination of the described components, features, and/or functions. Each method described herein may include any combination of the described steps in any order, including the absence of certain described steps. Any range of numeric values disclosed herein shall be construed to include any subrange therein.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. An emergency vessel towing system comprising:

a vessel attachment system configured to operatively connect to a disabled ocean-going vessel at sea, the vessel attachment system including a continuous bridle line and a hawser assembly having a hawser line and a hawser bushing, wherein the hawser bushing includes a central opening and a circumferential surface having a recessed channel, and wherein a proximal eye at a proximal end of the hawser line is secured in the recessed channel of the hawser bushing, wherein the continuous bridle line is slidingly disposed through the central opening of the hawser bushing, and wherein the continuous bridle line is configured to engage fittings on two sides of a foredeck of the vessel to distribute a load applied to the hawser line over the fittings on the two sides of the foredeck;

a retrieving system detachably connected to the vessel attachment system in a setup position, the retrieving system including a retrieving line;

a towing line detachably connected to the vessel attachment system in a towing position; and wherein in the setup position a distal end of the hawser line is detachably connected to a proximal end of the retrieving line and unconnected from the towing line; and wherein in the towing position the distal end of the hawser line is detachably connected to a proximal end of the towing line and unconnected from the retrieving line.

2. The emergency vessel towing system of claim 1, wherein the continuous bridle line includes a protected section to reduce wear.

3. The emergency vessel towing system of claim 1, wherein the hawser assembly further includes a hawser thimble having a central opening, wherein the hawser line includes a distal eye at its distal end, and wherein the hawser thimble is disposed within the distal eye of the hawser line.

4. The emergency vessel towing system of claim 3, wherein the hawser assembly further includes one or more floats operatively connected to the hawser line.

5. The emergency vessel towing system of claim 3, wherein the hawser assembly further includes a strap extending from a first end to a second end, the first end operatively attached to a distal end of the hawser line and the second end including a strap eye, and wherein the retrieving system further includes a retrieving shackle engaging the strap eye of the hawser assembly to detachably connect the retrieving system to the hawser assembly in the setup position.

6. The emergency vessel towing system of claim 3, wherein the hawser assembly further includes a grommet operatively attached to a distal end of the hawser line, wherein a distal end of the grommet provides an eye, and wherein the retrieving system further includes a retrieving shackle engaging the eye of the grommet to detachably connect the retrieving system to the hawser assembly in the setup position.

7. The emergency vessel towing system of claim 3, wherein the retrieving system further includes a retrieving shackle engaging the retrieving line to operatively secure the retrieving line through the central opening of the hawser thimble to detachably connect the retrieving system to the hawser assembly in the setup position.

8. The emergency vessel towing system of claim 3, wherein the retrieving system further includes a pilot anchor having a canopy and a plurality of shrouds extending from the perimeter of the canopy to the retrieving line.

9. The emergency vessel towing system of claim 8, wherein the retrieving system further includes an end buoy operatively connected near a distal end of the retrieving line and one or more marker buoys operatively connected to the retrieving line between the pilot anchor and the end buoy.

10. An emergency vessel towing system comprising:

a vessel attachment system configured to operatively connect to a disabled ocean-going vessel at sea, the vessel attachment system including a continuous bridle line and a hawser assembly having a hawser line and a hawser bushing wherein the hawser bushing includes a central opening and a circumferential surface having a recessed channel, wherein a proximal eye at a proximal end of the hawser line is secured in the recessed channel of the hawser bushing, wherein the continuous bridle line is slidingly disposed through the central opening of the hawser bushing, and wherein the continuous bridle line is configured to engage fittings on two sides of a foredeck of the vessel to distribute a load applied to the hawser line over the fittings on the two sides of the foredeck and to equalize the load distribution over the fittings independent of a position of the hawser bushing along the continuous bridle line; and a towing line detachably connected to the vessel attachment system in a towing position, wherein a proximal end of the towing line is detachably connected to the distal end of the hawser line in the towing position.

11. The emergency vessel towing system of claim 10, wherein the hawser assembly further includes a hawser thimble having a central opening, wherein the hawser thimble is disposed within a distal eye at the distal end of the hawser line, and wherein the hawser bushing is disposed within a proximal eye at the proximal end of the hawser line.

12. The emergency vessel towing system of claim 11, wherein the hawser assembly further includes one or more floats operatively connected to the hawser line.

13. A method of attaching a tow line to a vessel at sea, comprising the steps of:

a) providing a vessel attachment system and a retrieving system detachably connected to the vessel attachment system in a setup position; wherein the vessel attachment system comprises: a bridle system and a hawser assembly having a hawser line, wherein a proximal end of the hawser line is operatively connected to the bridle system; wherein the retrieving system includes a retrieving line having a proximal end that is detachably connected to a distal end of the hawser line in the setup position;

b) attaching the bridle system to fittings on two sides of a foredeck of the vessel with the vessel attachment system in the setup position;

c) detachably connecting the retrieving system to the vessel attachment system by operatively connecting the proximal end of the retrieving line to the distal end of the hawser line to place the vessel attachment system in the setup position;

d) running the bridle system through one or more chocks in the bow of the vessel to allow positioning of the distal end of the hawser line and the retrieving system in the sea;

e) using a towing vessel to recover a distal end of the retrieving line, and pulling the retrieving system and the distal end of the hawser line onto the towing vessel;

f) disconnecting the proximal end of the retrieving line from the distal end of the hawser line;

g) connecting a proximal end of a tow line to the distal end of the hawser line, and securing a distal end of the tow line to the towing vessel;

h) releasing the distal end of the hawser line and the proximal end of the tow line into the sea.

14. The method of claim 13, wherein the bridle system includes a first bridle and a second bridle, and wherein step (b) further includes wrapping the first bridle on a first bitt on a port side of the foredeck, and wrapping the second bridle on a first bitt on a starboard side of the foredeck; and belaying the first bridle to a second bitt on the port side of the foredeck, and belaying the second bridle to a second bitt on the starboard side of the foredeck.

15. The method of claim 13, wherein the bridle system includes a continuous bridle line, and wherein the hawser assembly further includes a hawser bushing having a central opening, the hawser bushing disposed within a proximal eye at the proximal end of the hawser line, wherein the continuous bridle line is slidingly disposed through the central opening of the hawser bushing, and wherein step (b) further includes wrapping a first end of the continuous bridle line on a first bitt on a port side of the foredeck, and wrapping a second end of the continuous bridle line on a first bitt on a starboard side of the foredeck; and belaying the first end of the continuous bridle line to a second bitt on the port side of the foredeck, and belaying the second end of the continuous bridle line to a second bitt on the starboard side of the foredeck.

16. The method of claim 13, wherein the hawser line includes a distal eye at its distal end; wherein the hawser assembly further includes a hawser thimble disposed within the distal eye of the hawser line, the hawser thimble having a central opening; wherein the retrieving system further includes a retrieving shackle engaging the retrieving line to operatively secure the retrieving line through the central opening of the hawser thimble in the setup position; and wherein step (f) further includes disconnecting the retrieving shackle from the retrieving line to release the retrieving line from the central opening of the hawser thimble to disconnect the proximal end of the retrieving line from the distal end of the hawser line.

17. The method of claim 13, wherein the hawser line further includes a distal eye at its distal end; wherein the hawser assembly further includes a strap attached to the distal end of the hawser line and a hawser thimble disposed within the distal eye of the hawser line, the hawser thimble having a central opening; wherein a distal end of the strap includes a strap eye; wherein the retrieving system further includes a retrieving shackle engaging the strap eye of the hawser assembly to detachably connect the retrieving system to the hawser assembly in the setup position;

and wherein step (f) further includes disconnecting the retrieving shackle from the strap eye to disconnect the proximal end of the retrieving line from the distal end of the hawser line.

* * * * *